US005419445A

United States Patent [19]

Kaesemeyer

[11] Patent Number: 5,419,445

[45] Date of Patent: May 30, 1995

[54] CONTAINER FOR STORING, MIXING AND DISPENSING

[76] Inventor: David M. Kaesemeyer, 2360 Fordyce Rd., Clarksville, Ohio 45113

[21] Appl. No.: 265,407

[22] Filed: Jun. 24, 1994

[51] Int. Cl.[6] ..... A61J 9/00

[52] U.S. Cl. ..... 215/11.1; 215/11.4; 215/DIG. 8; 206/220

[58] Field of Search ..... 206/219, 220; 215/11.1, 215/11.4, 11.5, 6, 219, 220, DIG. 8

[56] References Cited

U.S. PATENT DOCUMENTS

| | | | |
|---|---|---|---|
| 2,533,806 | 1/1949 | Holzapfel . | |
| 2,721,552 | 10/1955 | Nosik . | |
| 2,773,591 | 12/1956 | Jensen . | |
| 2,781,141 | 2/1957 | Lucien | 215/6 X |
| 2,786,769 | 3/1957 | Greenspan . | |
| 2,793,776 | 5/1957 | Lipari . | |
| 2,807,384 | 9/1957 | Lipari . | |
| 2,813,649 | 11/1957 | Lipari . | |
| 2,885,104 | 5/1959 | Greenspan . | |
| 2,931,731 | 4/1960 | Pohjola . | |
| 3,458,076 | 7/1969 | Babcock | 215/6 |
| 3,599,838 | 8/1971 | LaVange | 215/6 X |
| 3,613,955 | 10/1971 | Wetherell | 215/DIG. 8 |
| 4,024,952 | 5/1977 | Leitz | 215/DIG. 8 |
| 4,053,648 | 10/1977 | Schmid et al. | 215/11.1 X |
| 4,177,938 | 12/1979 | Brina | 215/6 X |
| 4,203,517 | 5/1980 | Hildebrandt et al. | 215/DIG. 8 |
| 4,386,696 | 6/1983 | Goncalves | 206/219 X |
| 4,513,861 | 4/1985 | Baram | 206/219 |
| 4,527,701 | 7/1985 | Schaubeck | 215/220 |
| 4,793,475 | 12/1988 | Itzel | 206/219 X |
| 5,071,017 | 12/1991 | Stul | 215/11.4 X |
| 5,217,433 | 6/1993 | Bunin | 215/DIG. 8 |
| 5,275,298 | 1/1994 | Holley, Jr. et al. . | |

*Primary Examiner*—Allan N. Shoap
*Assistant Examiner*—Christopher McDonald

[57] ABSTRACT

A baby bottle 10 with two separate compartments for storage of powdered baby formula 104 and water 106. Water 106 is stored in a bottle portion 12 and baby powdered formula 104 is stored in a cartridge assembly 14. The cartridge assembly 14 consists of a housing member 16, a seal member 18, a storage cylinder 20 and a nipple assembly 22. Nipple assembly is attached to the top of storage cylinder 20 which is disposed through the top of housing member 16. Seal member 18 is attached to the bottom of housing member 16 and engages an opposing mating surface on the bottom of storage cylinder 20, thus providing a releasable connecting means to disconnect the seal member 18 from the housing member by allowing the seal member to be turned by the storage cylinder. The bottom of housing member 16 is attached to the top of bottle portion 12. Seal member 18 provides an internal leakproof seal that can be released by external means at a desired time by rotating nipple assembly 22. As a result, storage cylinder 20 forces seal member 18 to detach itself from the bottom of housing member 16. The seal member 18 and powdered formula 104 both fall into water 106. The seal member 18 can provide a more efficient means of mixing the water 106 and powder 104 together while the bottle 10 is being shaken. Once thoroughly shaken, the liquid formula is consumed through the end of a nipple 72.

20 Claims, 7 Drawing Sheets 72
68
70
22
62
110
30
28
26
20
112
112
OZ CC
8 — 240
7 — 210
6 — 180
5 — 150
4 — 120
3 — 90
2 — 60
1 — 30
12
64
111
32
108
16
36
38
34
109
18
24
14
10

CONTAINER FOR STORING, MIXING AND DISPENSING

BACKGROUND OF THE INVENTION

1. Field of the Invention

This invention relates to the storage, mixing and dispensing of substances and more specifically to an improved baby bottle for storing powdered baby formula and water in separated compartments where thereafter may be mixed within the baby bottle and dispensed as desired.

2. Discussion of the Background Art

Powdered baby formula is mixed with water to produce a milk type liquid formula for consumption by infants. Baby formula is either mixed in batch form or individually in baby bottles. Powdered baby formula in present use requires a mixing ratio of approximately four parts water to one part powder. When the parts are mixed, the total volume does not equal the sum of the individual parts. In other words, if eight parts water are mixed with two parts powder the total mixture does not yield ten total parts but only nine. This is due to the fact that the powder in volume contains air and when mixed with water the water fills in any space the air once occupied. Once the liquid formula is mixed it spoils quickly and must be consumed within a short period of time, usually two hours, or refrigerated to use later, usually within twenty-four hours. Once refrigerated, liquid formula should be warmed prior to consumption. Powdered baby formula and water, each in separate containers at room temperature, have a much longer shelf-life than when mixed together.

It is sometimes inconvenient and impossible to travel with infants who may require feeding every two to four hours and take as little as two to four ounces of formula at a time. Since it is inadvisable to permit liquid formula to remain unrefrigerated for long periods of time, a portable cooler is then required while traveling. If a heat source is unavailable to warm the chilled formula the infant is then forced to drink from a cold bottle and possibly an improper feeding may result. Another way of traveling with infants that require feeding is to mix the formula when needed. This can be very messy and difficult and requires the use of both hands and a stable flat surface to work from. Since it is also inadvisable to reuse any unused portions of a prior feeding, it then becomes necessary to mix only the amount required to avoid any unnecessary waste. In present use, the conventional baby bottle is available mainly in two sizes, four ounce and eight ounce. All major baby bottle manufactures have created a standard to making baby bottles of the same similar shape and size with a universal type nipple assembly that is interchangeable with most any type baby bottle.

Heretofore, numerous containers that store, mix and dispense substances have been proposed and utilized, none of which reached any real commercial success. U.S. Pat. No. 5,275,298 to Holley, 1994 added to the overall height and size of a conventional baby bottle making it awkward to handle. It took three separate movement of parts to operate the bottle and required the use of both hands. There was no way of preventing powdered formula from clumping or caking in the nipple area if bottle was inverted during storage. It appears only one size was available, which if used with a four ounce bottle would almost double the size and mass of said bottle. Assembly was difficult and manufacturing of tight spherical tolerances expensive. U.S. Pat. No. 2,786,769 to Greenspan, 1957 would not even sit upright on a flat surface. Proper mixing of contents took very long and was not assured due to the small opening separating the powder storage from the water storage. To assemble and operate took very many rotations of a threaded shank to dislodge a rubber stopper. Once the stopper was dislodged to allow mixing of contents, the stopper could block flow of formula in the nipple end if bottle is in an inverted position. U.S. Pat. No. 2,793,776 to Lipari, 1957 had hard to clean parts, was difficult to load and a thorough mixing of contents was difficult to achieve due to a stopper restricting the opening separating the powder storage from the water storage. U.S. Pat. No. 2,807,384 to Lipari, 1957 had a rupturable seal that had to be replaced after each use. It had hard to clean parts and was not of any conventional shape or size. U.S. Pat. No. 2,813,649 to Lipari, 1957 was difficult to assemble, had many parts, was hard to clean and was also of an unconventional shape and size. U.S. Pat. No. 2,885,104 to Greenspan, 1959 used a disposable cartridge that was difficult to load and assemble and was not reusable.

All of the prior art mentioned did not provide for an agitator to help with a more efficient means of the mixing the ingredients while shaking. The prior art also did not have a means of preventing any liquid formula from leaking from the end of the nipple opening while shaking the bottle. The prior art also did not take advantage of the vanishing volume of the powder as mentioned earlier when the water fills in the air space within the powder. There was also no consideration to different size receptacles. This is important since small infants require small amounts of formula at shorter intervals and larger older infants require larger amounts at longer intervals. None of the prior art could be activated, shaken and mixed with a minimal of effort.

SUMMARY OF THE INVENTION

A baby bottle that provides for storing pre-measured amounts of powdered baby formula and water in separate compartments for extended periods of time which can later be activated, shaken and dispensed with a minimal of effort and provide an amusement toy for an infant after feeding.

An object of the invention is to provide for an internal seal that separates the powder from the water that can be easily released by external means with minimal effort.

A further object of the invention is to provide an agitator for a more efficient means of mixing powder and water together.

A further object of the invention is to provide for separate storage compartments that merge together during activation thereby making for a smaller container.

A further object of the invention is to provide for a baffle to prevent powder from caking or clumping inside the nipple.

A further object of the invention is to provide for a leak proof nipple shield.

A further object of the invention is to provide for easy loading of powder and water in their separate storage compartments.

A further object of the invention is to provide for easy to assemble parts.

A further object of the invention is to provide for reusable easy to clean parts.

A further object of the invention is to provide for more than one size and still be relatively close in shape and size of conventional baby bottles.

A further object of the invention is to provide for a toy rattle for an infants amusement.

A baby bottle in accordance with the present invention includes a lower bottle portion for water storage and an upper cartridge assembly for powder storage. The bottle portion has a closed end base for standing in an upright position and an upper open end for connecting to cartridge assembly. The cartridge assembly includes a housing, a storage cylinder, a seal member and a nipple assembly. The housing has an upper open end and a lower open end. The lower open end of the housing attaches to the upper open end of the bottle. The storage cylinder is disposed within and through the upper end of the housing. The seal member attaches to the lower open end of the housing and mates and engages with the lower open end of the storage cylinder thus providing a releasable connecting means to disconnect seal agitator from the housing by allowing the storage cylinder to turn the seal member. The nipple assembly attaches to the top of the storage cylinder and includes a cap, a nipple, a nipple shield and a baffle. The baffle is located between the nipple and the storage cylinder to prevent any powder from entering and caking inside the nipple if the bottle is accidentally tipped over while in its storage mode. When the storage cylinder is rotated, it pushes against and turns the seal member and releases its connection to the housing. The seal member falls into the water providing an unrestricted opening between the two storage compartments. While shaking the bottle, the seal member provides for a more efficient means of mixing the ingredients together. The nipple shield provides for a leak proof means around the end of the nipple. Since the baby bottle is relatively close in size and shape to a conventional baby bottle, it is easily handled by an infant. After the contents are consumed, the bottle can serve as a toy rattle for the infants amusement.

Still further objects and advantages will become apparent from a consideration of the ensuing description and drawings.

BRIEF DESCRIPTION OF THE DRAWINGS

The novel features believed characteristic of the present invention are set forth and differentiated in the claims. The invention, together with further objects and advantages thereof, is more particularly described in conjunction with the accompanying drawings in which:

DESCRIPTION OF THE PREFERRED EMBODIMENT

Figure 1:
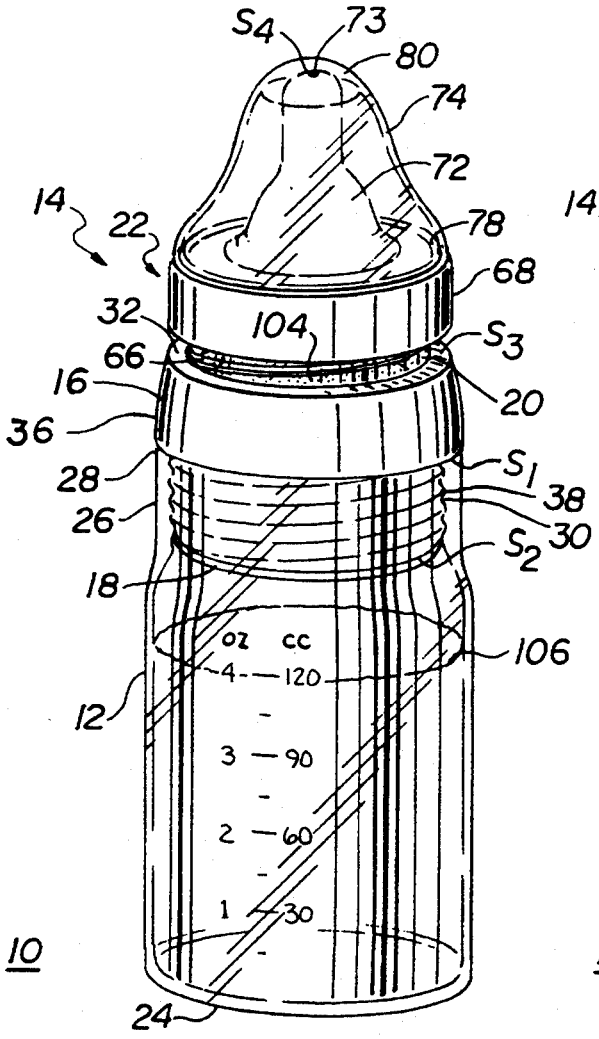
FIG. 1 is a perspective view of the baby bottle in its storage mode in accordance with a preferred embodiment of the present invention shown in a four ounce version.
Figure 1A:
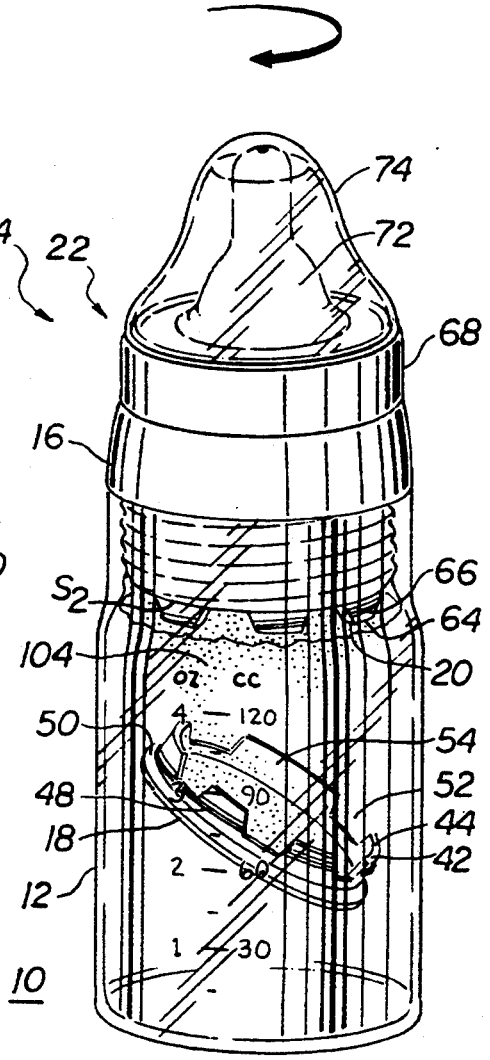
FIG. 1*a* is a perspective view of the baby bottle in FIG. 1 being operated.
Figure 2:
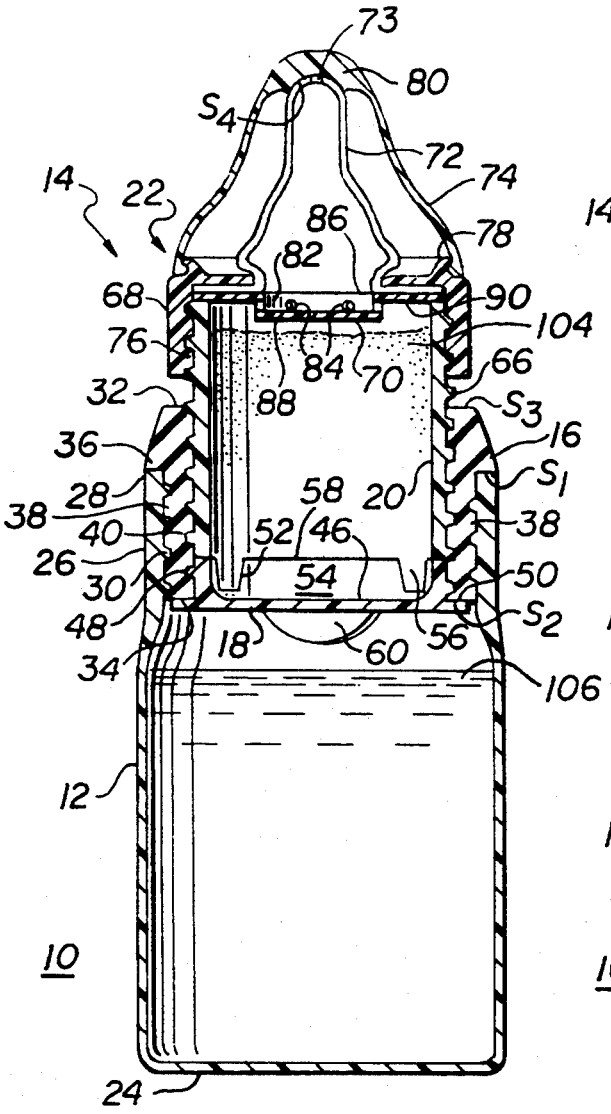
FIG. 2 is a section view of the baby bottle shown in FIG. 1.
Figure 2A:
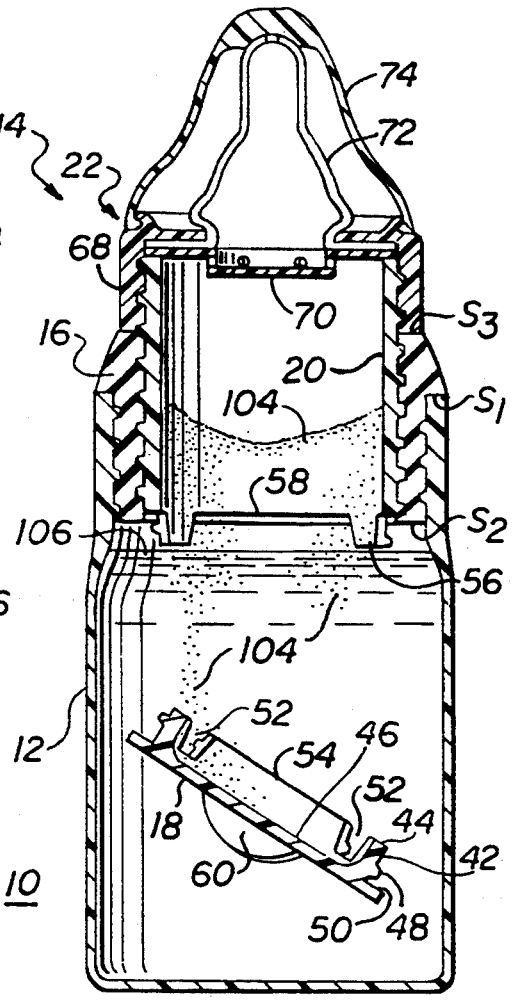
FIG. 2*a* is a section view of the baby bottle shown in FIG. 1*a*.
Figure 3:
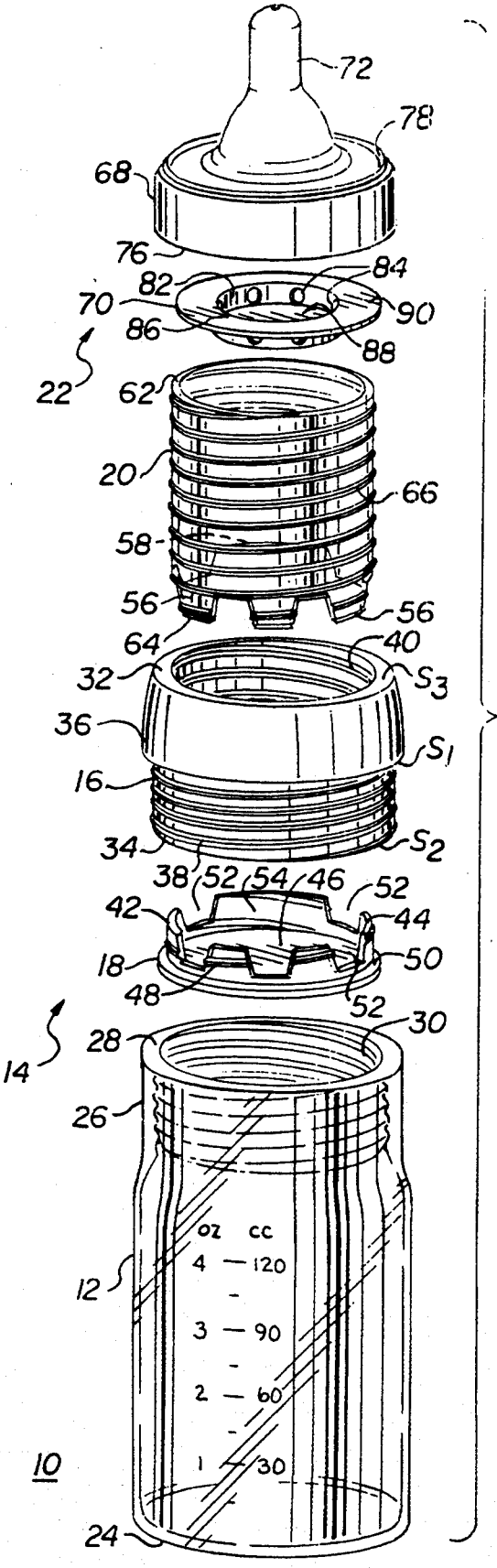
FIG. 3 is an exploded view of FIG. 1.

FIGS. 1–3 show a baby bottle in accordance with the present invention in a four ounce version in which the baby bottle has been designated 10, which is comprised of a lower bottle portion 12, and an upper cartridge assembly 14. Cartridge assembly 14 is comprised of a housing member 16, a seal member 18, a storage cylinder 20 and a nipple assembly 22. All parts are preferably made of plastic or rubber.

Bottle portion 12 is a cylindrical-shaped container with a closed end base 24, a slightly reduced diameter neck portion 26 and an upper open end 28. Upper end 28 has internal connecting threads 30, which attaches to the cartridge assembly 14.

Housing member 16 is cylindrically shaped and has a lower first open end 34, an upper second open end 32 and an annular flange 36. Housing member 16 has external connecting threads 38 for attaching to internal connecting threads 30 of the bottle portion 12. Housing member 16 also has internal connecting threads 40 for attachment of seal member 18 and storage cylinder 20. Housing member 16 has three leakproof sealing surfaces S1, S2 and S3. Sealing surface S1 seals against upper open end 28 of bottle portion 12. Sealing surface S2 seals against seal member 18 and seal surface S3 seals against nipple assembly 22.

Seal member 18 has a cylindrical wall 42 with an upper first open end 44 and a lower closed end base plate 46. Cylindrical wall 42 has external connecting threads 48 for attaching the cylindrical wall to lower open end 34 of housing member 16 by engaging the internal connecting threads 40, thus providing a releasable connecting means to disconnect the seal member 18 from the housing member. Base plate 46 extends beyond the outside of cylinder wall 42 to provide a lip 50 which seals against surface S2 of housing member 16. Upper open end 44 of cylinder wall 42 has a plurality of notches 52 equally sized and spaced about circumference of cylinder wall 42 with a single notch omitted to create a key tab 54 that will along with notches 52 mate and engage with opposing tabs 56 and key notch 58 of the storage cylinder 20. This is an additional feature of the releasable connecting means enhancing the invention's operability by allowing the seal member 18 to be turned by the storage cylinder 20. A finger grip tab 60 is found on the bottom of base plate 46 for ease of handling while assembling.

Storage cylinder 20 is a hollow cylinder with a lower first open end 64, an upper second open end 62 and external connecting threads 66, which are used for attaching to internal connecting threads 40 of housing member 16 and for attaching a nipple assembly 22. Storage cylinder 20 further includes a plurality of tabs 56 equally sized and spaced about circumference of lower first open end 64 with a single tab omitted to create a key notch 58. When tabs 56 and key notch 58 are mated and engaged with opposing notches 52 and key tab 54 of seal member 18, the external threads 66 are aligned with external threads 48 so as to share the same thread pattern with each other and with internal threads 40 of housing member 16 once assembled.

Nipple assembly 22 is attached to external threads 66 of upper second open end 62 of storage cylinder 20 and includes a cap 68, a baffle 70, a nipple 72 and a nipple shield 74. Cap 68 and rubber nipple 72 are of conventional construction and are well known. Cap 68 has internal connecting threads for attaching to external threads 66 of storage cylinder 20. A nipple shield 74 is attached to cap 68 with a snap ring ridge 78. Nipple shield 74 is also of conventional construction and well known, but with a modification to upper end 80. Upper end 80 is shaped to fit snugly on top of nipple 72 and block nipple opening 73 providing a leakproof seal surface S4. A baffle 70 is located under the nipple 72 within the cap 68. Baffle 70 includes a cylindrical wall 82 with several holes 84 located about circumference of wall 82. Cylindrical wall 82 includes an upper open end 86 a lower closed end plate 88 and an annular flange 90 located around upper open end 86.

Figure 4A:
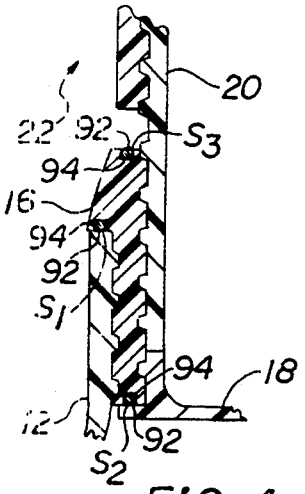
FIGS. 4*a* and 4*b* are partial section views showing alternate sealing methods.
Figure 4B:
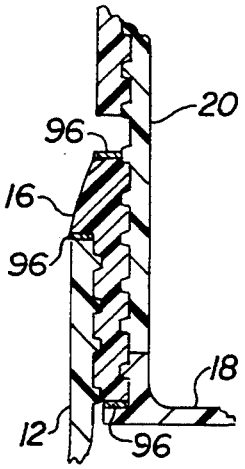

FIGS. 4*a* and 4*b* show alternate methods of providing a leakproof seal for housing member 16. An O-ring 92 is fitted into groove 94 in housing member 16 or a gasket 94 can be used.

Figure 5:
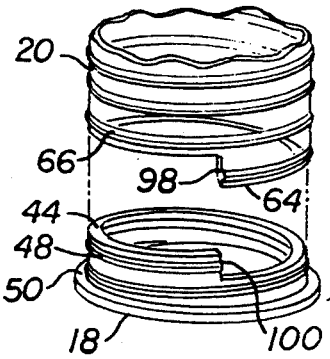
FIG. 5 is a partial exploded view of an alternate engagement method between seal member and storage cylinder.

FIG. 5 shows an alternate method of engagement between seal member 18 and storage cylinder 20. Lower first open end 64 of storage cylinder 20 is cut parallel to external treads 66 and terminates at a step 98. Upper first open end 44 of seal member 18 is also cut parallel to external threads 48 and terminates at a step 100 thereby creating mating opposing surfaces and keeping thread pattern alignment.

OPERATION OF THE PREFERRED EMBODIMENT

Operation of baby bottle 10 can be explained with aid of FIGS. 1, 1*a*, 2 and 2*a*. Assembly and loading of compartments will be explained first with the aid of FIG. 3. With the bottle 10 disassembled, as shown in FIG. 3, lower open end 64 of storage cylinder 20 is inserted into upper second open end 32 of housing member 16, by engaging external connecting threads 66 into internal connecting threads 40. Storage cylinder 20 is then screwed into position where tabs 56 are fully extended beyond lower first open end 34 of housing member 16. Notches 52 of seal member 18 are then mated and engaged with tabs 56 of storage cylinder 20 aided by key tab 54 and key notch 58 to assure proper thread pattern alignment. With the aid of finger grip tab 60, seal member 18 is screwed into lower first open end 34 of housing member 16 until lip 50 seals finger tight against surface S2. A predetermined amount of powdered baby formula 104 is then inserted through upper open end 62 of storage cylinder 20. Nipple assembly 22 is then connected to upper second open end 62 of storage cylinder 20 by engaging internal treads 76 and external threads 66 until finger tight. The cartridge assembly 14 is now loaded and fully assembled. A predetermined amount of water 106 is inserted into bottle portion 12 through upper open end 28. The cartridge assembly 14 can now be connected to bottle portion 12 by engaging external connecting threads 38 of housing member 16 and internal connecting threads 30 of upper open end 28 of bottle portion 12 until surface S1 of flange 36 seals finger tight against upper open end 28. The baby bottle 10 is now fully assembled, loaded and in its storage mode to be later activated and dispensed as desired. If bottle 10 is accidentally tipped over while in its storage mode, the baffle 70 will prevent large amounts of powdered formula 104 from entering and caking into nipple 72.

Operation of baby bottle 10 once loaded is explained with the aid of FIGS. 1, 1*a*, 2 and 2*a*. Nipple assembly 22 is rotated clockwise with as little as, but not limited to, one half of a revolution until cap 68 is sealed finger tight against surface S3 of housing member 16. As a result storage cylinder 20 turns and forces seal member 18 out of its connection to lower first open end 34 of housing member 16. Seal member 18 and powered formula 104 are released into water 106. Bottle 10 is then shaken with seal member 18 aiding in the mixing process. While shaking, nipple shield 74 prevents liquid formula from squirting from end of nipple opening 73. Once thoroughly shaken, nipple shield 74 is removed and bottle 10 is ready for an infant to consume the contents. Once the contents are consumed, bottle 10 can be shaken to produce a rattling noise which is a result of seal member 18 bouncing around within bottle portion 12. The bottle 10 then becomes an amusement toy for an infant.

DESCRIPTION OF SECOND EMBODIMENT

Figure 6:
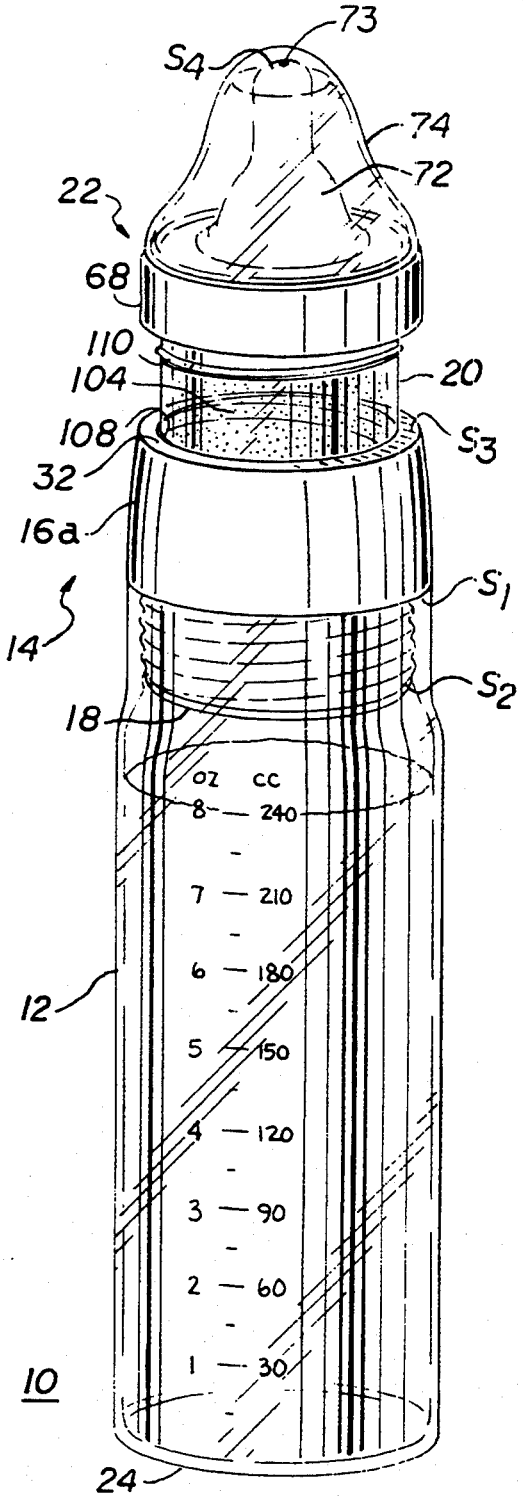
FIG. 6 is a perspective view of a second embodiment in accordance with the present invention shown in an eight ounce version.
Figure 6A:
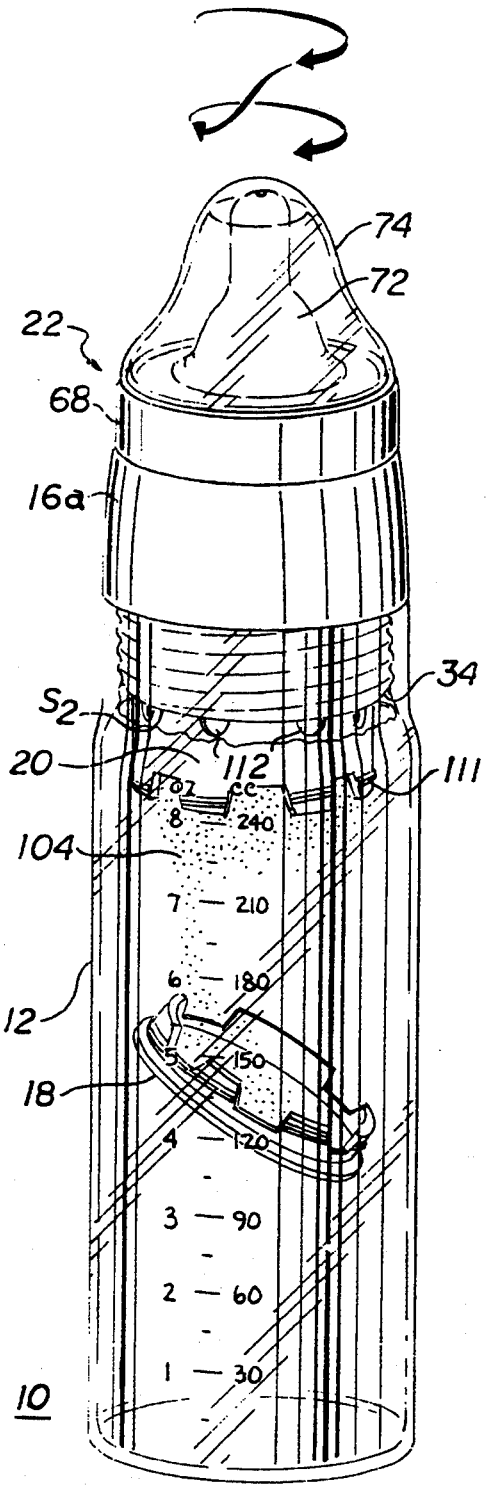
FIG. 6*a* is a perspective view of FIG. 6 being operated.
Figure 7:
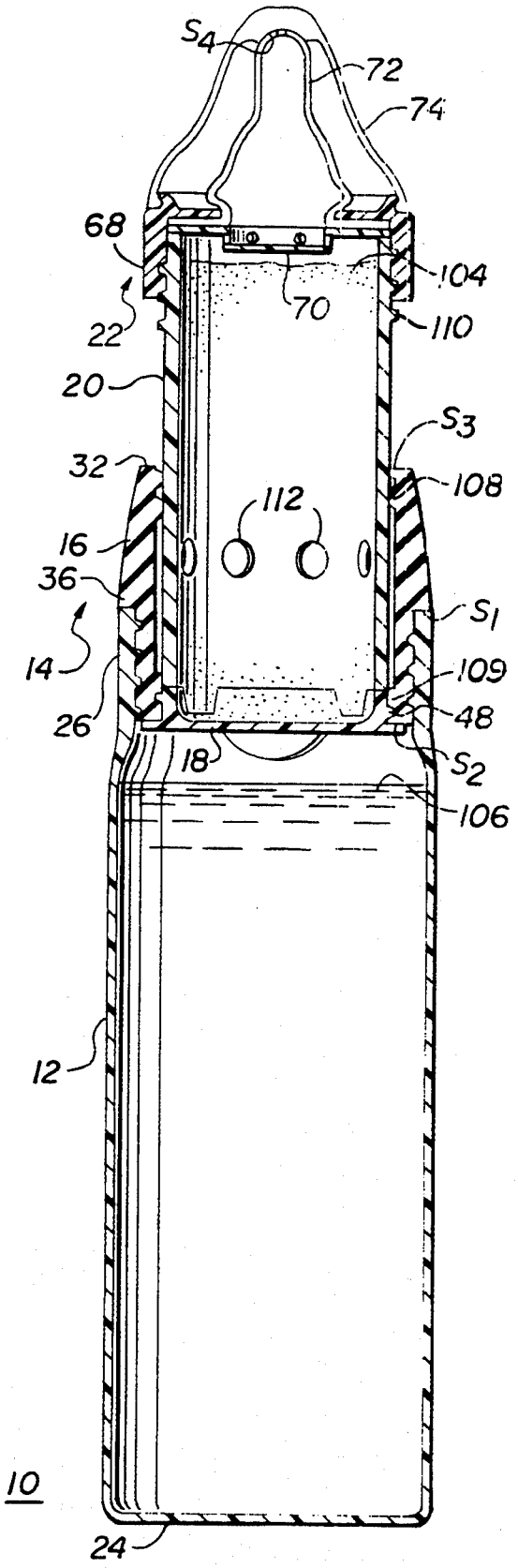
FIG. 7 is a section view of FIG. 6.
Figure 7A:
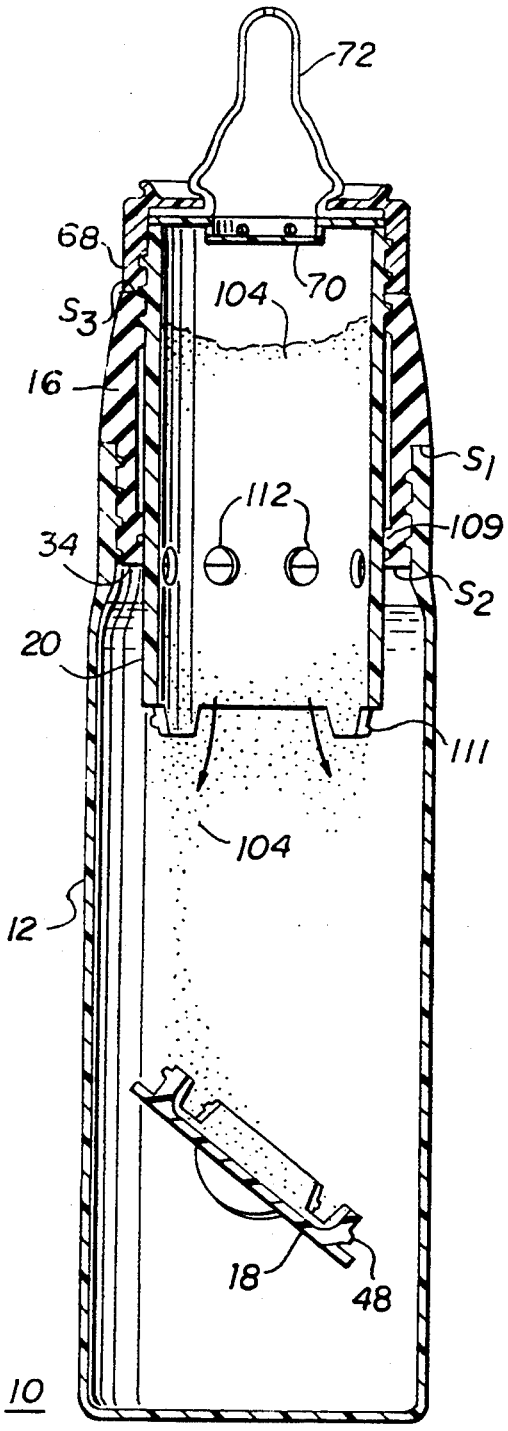
FIG. 7*a* is a section view of FIG. 6*a*.
Figure 8:
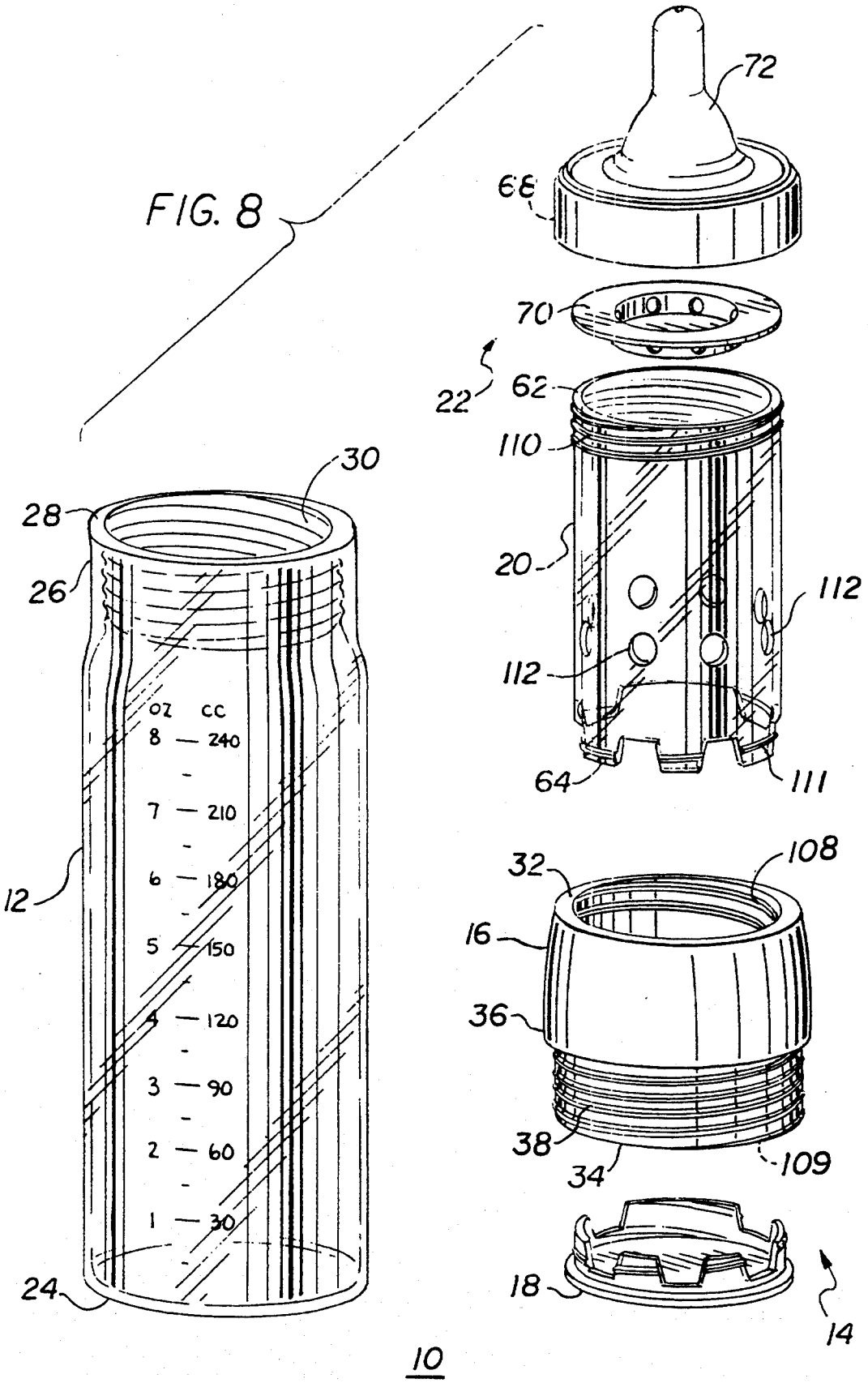
FIG. 8 is an exploded view of FIG. 6.
Figure 9A:
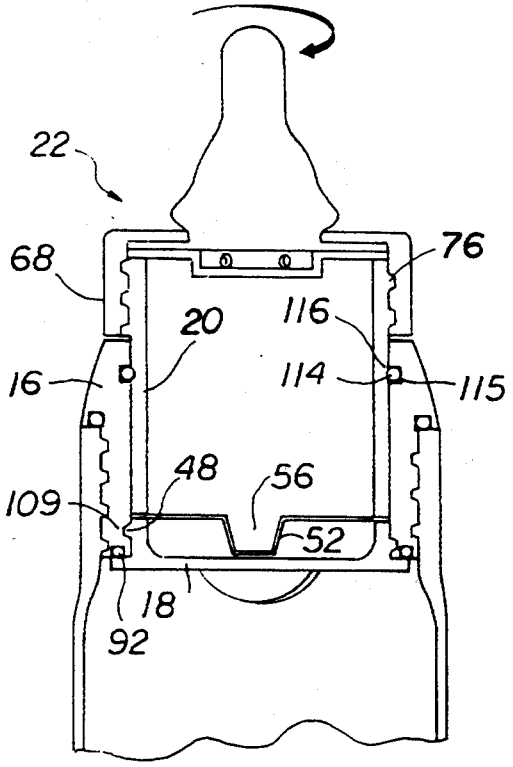
FIG. 9*a* is a partial section view of a third embodiment.
Figure 9B:
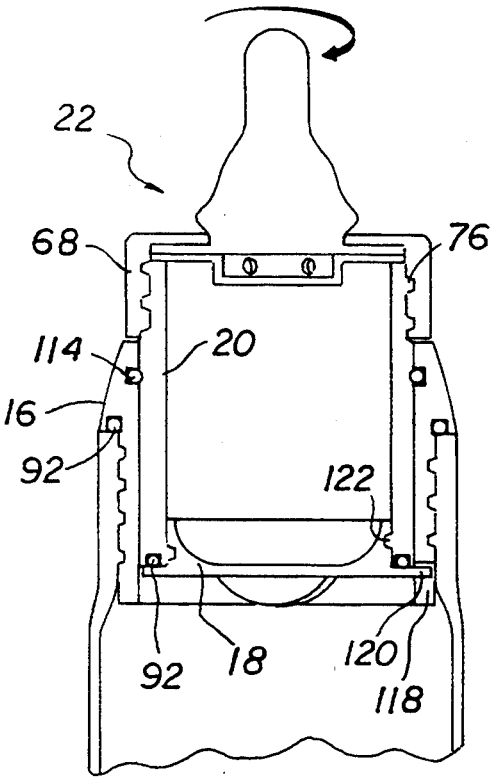
FIG. 9*b* is a partial section view of a fourth embodiment.
Figure 9C:
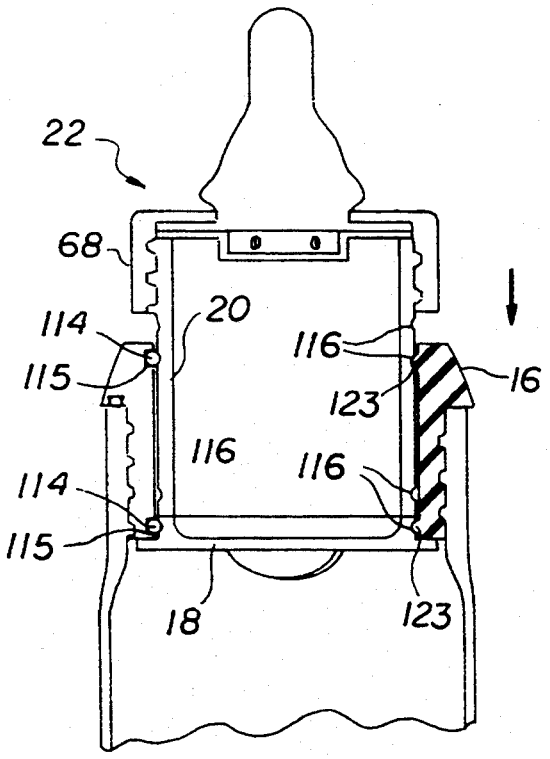
FIG. 9*c* is a partial section view of a fifth embodiment.

FIGS. 6–8 show a baby bottle 10 in accordance with the present invention, shown in an eight ounce version, which differs slightly from bottle 10 shown in FIGS. 1–3. Bottle portion 12 has been lengthened along with housing member 16 and storage cylinder 20 of cartridge assembly 14.

Bottle portion 12 has been lengthened between base 24 and neck portion 26 to accommodate for several more fluid ounces.

Housing member 16 has been lengthened between upper second open end 32 and flange 36. A set of internal connecting threads 108 are located at upper second open end 32 and a set of internal connecting threads 109 located at lower first open end 34.

Storage cylinder 20 has been lengthened between upper second open end 62 and lower first open end 64. Two sets of external connecting threads 110 are located at upper second open end 62 and one set of external connecting threads 111 are located at lower first open end 64 of storage cylinder 20. Several holes 112 are located about circumference of storage cylinder 20 between upper second open end 62 and lower first open end 64.

OPERATION OF SECOND EMBODIMENT

Assembly and loading of compartments are the same as the first embodiment and is illustrated in FIG. 8.

Operation of baby bottle 10 once loaded and assembled differs slightly from that of the first embodiment and is explained with the aid of FIGS. 6, 6*a*, 7 and 7*a*. By rotating nipple assembly 22 clockwise, storage cylinder 20 forces seal member 18 out of its threaded connection to lower first open end 34 of housing member 16. As a result, seal member 18 and powder 104 are released into water 106. Storage cylinder 20 is further inserted through housing member 16 by continuing to rotate and push in a downward direction until external threads 110 engage internal threads 108 and cap 68 is sealed finger tight against surface S3. Shaking and mixing are the same as the first embodiment but consumption is aided by the addition of holes 112 which are positioned to allow proper drainage of liquid formula when bottle 10 is in an inverted position.

It would be apparent to anyone skilled in the art that several versions may be made to the baby bottles described above and should not be limited to the four ounce and eight ounce versions as illustrated as it would be apparent that any size container could be used while remaining within the spirit and scope of the present invention. FIGS. *9a, 9b, 9c* and 10 show additional embodiments of the invention. In FIG. *9a,* any screwing down motion can be replaced by just rotating nipple assembly 22 clockwise until tab 56 of storage cylinder 20 forces notch 52 to unscrew seal member 18 external connecting thread 48 from internal connecting thread 109 of housing member 16. Tab 56 has no external threading. An o-ring 114 is located in a holding groove 115 of housing member 16 to provide a leakproof seal around storage cylinder 20 which is semi-locked in place with placement groove 116 located about circumference of storage cylinder 20.

In FIG. *9b,* instead of attaching seal member 18 to housing member 16, it is attached to storage cylinder 20. One or several notches 118 or tabs 120 can be used as an engagement means, such that when nipple assembly 22 is rotated clockwise, storage cylinder 20 is forced to release seal member 18 opposite hand threaded connection 122. While storage cylinder 20 is rotated, seal member 18 cannot due to tab 120 located in notch 118. Seal member 18 just moves downward and falls into the water.

In FIG. *9c,* any rotational motion can be totally replaced by a simple downward motion. Any connecting threads can be eliminated and replaced by o-rings 114 located in holding grooves 115, semi-locking in place seal member 18 and storage cylinder 20 with placement grooves 116. Thus, when a downward motion is applied to nipple assembly 22, storage cylinder 20 forces seal member 18 out of its contact with o-ring 114 in housing member 16 and falls into the water. The o-rings 114 could be made an integral part of housing 16 by employing a ridge 123.

Figure 10:
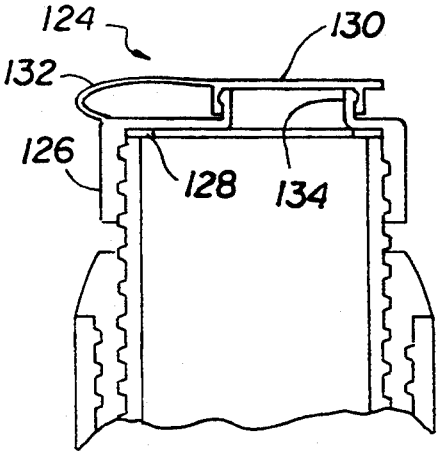
FIG. 10 is a partial section view of a sixth embodiment.

FIG. 10 shows another embodiment where the invention would not have to be limited to infants but could be used for adult-type drinks such as powdered diet drinks, powdered milk or any type of substances that might require refrigeration or immediate consumption after mixing by replacing the nipple assembly with a bottle cap assembly 124 that comprises a cap member 126 which screws onto storage cylinder 20. A gasket 128 is used to provide a leakproof seal for cap member 126. An optional flip top lid 130 could be incorporated by attaching it to cap member 126 with a strap 132. Cap member 126 would have a neck portion 134 that flip top lid 130 would snap over and onto.

While the preferred embodiment of the invention has been described fully in order to explain its principles, it is understood that various modifications or alterations may be made to the preferred embodiment without departing from the scope of the invention as set forth in the appended claims.

I claim:

1. A container comprising:

a bottle defining a bottle opening having first mating threads and an interior for storing a substance;

a housing having second mating threads connected to said first mating threads on said bottle opening, said housing defining a first open end communicating with said bottle opening, said housing also defining a second open end;

a storage cylinder having an interior for storing a substance, said cylinder is disposed within said housing, said cylinder further defines a first open end and a second open end, said first open end of cylinder communicating with said second open end of said housing, said storage cylinder interior also communicating with said bottle interior;

a seal member operably disposed to block communication between said bottle interior and said storage cylinder interior, said seal member connected to said first open end of said housing and also engaging said first open end of said cylinder by a releasable connecting means to disconnect said seal member from said housing when a directional means of force is applied to said hollow cylinder and whereby said hollow cylinder interior communicates with said bottle interior; and a nipple assembly connected to said second open end of said storage cylinder.

2. The container of claim 1 wherein said nipple assembly further comprises a baffle located between said nipple and said second open end of storage cylinder to provide for a blocking means of preventing any powdered substances from caking inside the nipple.

3. The container of claim 1 wherein said nipple assembly further comprises a nipple shield which provides a leakproof means of preventing substances from leaking from end of nipple.

4. The container of claim 1 wherein said seal member is connected to said housing by mating external threads disposed on said seal member with internal threads disposed on said housing.

5. The container of claim 4 wherein said seal member includes a cylinder wall having a first end around which a plurality of notches are disposed with a single notch omitted to form a key tab that along with said notches engages with an opposing plurality of tabs and key notch on said storage cylinder.

6. The container of claim 4 wherein said seal member includes a cylinder wall having a first end around which a single notch is disposed to engage with an opposing tab on said storage cylinder.

7. The container of claim 4 wherein said seal member includes a cylinder wall having a first end, a surface of said first end is parallel to said external connecting threads and terminates at a step that will engage with an opposing parallel surface and step on said storage cylinder.

8. The container of claim 1 wherein said directional means of force is a screwing motion.

9. The container of claim 1 wherein said directional means of force is a rotational motion.

10. The container of claim 1 wherein said seal member is connected to said housing with an o-ring disposed between a holding groove and a placement groove, said o-ring and said holding groove disposed in one of said seal member and said housing.

11. The container of claim 1 wherein said seal member is connected to said housing with a ridge integrally attached to one of said seal member and said housing.

12. The container of claim 1 wherein said directional means of force is a linear motion.

13. The container of claim 1 wherein seal member provides a rattling means of producing noise within said bottle for amusement of an infant.

14. The container of claim 1 wherein said seal member facilitates mixing of the ingredients.

15. The container of claim 1 wherein said nipple assembly is a bottle cap assembly.

16. A container comprising:

a bottle defining a bottle opening having first mating threads and an interior for storing a substance;

a housing having second mating threads connected to said first mating threads on said bottle opening, said housing defining a first open end communicating with said bottle opening, said housing also defining a second open end;

a storage cylinder having an interior for storing a substance, said cylinder is disposed within said housing, said cylinder further defines a first open end and a second open end, said first open end of cylinder communicating with said second open end of said housing, said storage cylinder interior also communicating with said bottle interior;

a seal member operably disposed to block communication between said bottle interior and said storage cylinder interior, said seal member connected to said first open end of said storage cylinder and also engaging said first open end of said housing by a releasable connecting means to disconnect said seal member from said storage cylinder when a directional means of force is applied to said storage cylinder and whereby said storage cylinder interior communicates with said bottle interior; and a nipple assembly connected to said second open end of said storage cylinder.

17. The container of claim 16 wherein said seal member is connected to said storage cylinder by mating internal threads disposed on said storage cylinder with external threads disposed on said seal member.

18. The container of claim 16 wherein said seal member further includes a tab which is disposed to engage with an opposing notch on said housing.

19. The container of claim 16 wherein said nipple assembly further comprises a baffle located between said nipple and said second open end of storage cylinder to provide for a blocking means of preventing any powdered substances from caking inside the nipple.

20. The container of claim 16 wherein said nipple assembly is a bottle cap assembly.

* * * * *